US005653035A

United States Patent [19]

Chen

[11] Patent Number: 5,653,035

[45] Date of Patent: Aug. 5, 1997

[54] PAD DEVICE HAVING A REMOVABLE RULE

[76] Inventor: Ching-Tang Chen, No. 6, Ming De Street, Hua Tan Hsiang, Chang Hua County, Taiwan

[21] Appl. No.: 562,807

[22] Filed: Nov. 27, 1995

[51] Int. Cl.[6] ..... B43L 5/02

[52] U.S. Cl. ..... 33/484; 33/430; 33/1 K

[58] Field of Search ..... 33/484, 1 K, 1 AA, 33/1 BB, 11, 16, 403, 430, 434, 448, 485, 486, 489, 562, 19.1, 19.2, 32.1, 32.2, 41.1, 526, 18.1

[56] References Cited

U.S. PATENT DOCUMENTS

| | | | |
|---|---|---|---|
| 2,642,841 | 6/1953 | Funk | 33/448 |
| 2,765,543 | 10/1956 | Crowell et al. | 33/448 |
| 2,770,042 | 11/1956 | Hone | 33/403 |
| 4,027,395 | 6/1977 | Vlahakis | 33/11 |
| 4,030,200 | 6/1977 | Francis | 33/11 |
| 4,577,415 | 3/1986 | Sciller | 33/430 |

*Primary Examiner*—Christopher W. Fulton
*Attorney, Agent, or Firm*—Charles E. Baxley, Esq.

[57] ABSTRACT

A pad device includes a hole formed in the edge portion for engaging with a screw. A board has an opening engaged with the screw and has two legs and a gap formed between the legs. The legs each has a recess formed in the bottom portion. A knob is threaded to the screw for securing the board to the pad. A rule has a shaft engaged in the recesses of the legs such that the rule may rotate relative to the board and such that the rule may be disengaged from the pad when the board is secured to the pad. The rule includes one or two edges each having a metal strip for protecting the rule from being cut.

4 Claims, 4 Drawing Sheets

PAD DEVICE HAVING A REMOVABLE RULE

BACKGROUND OF THE INVENTION

1. Field of the Invention

The present invention relates to a pad, and more particularly to a pad device having a removable rule.

2. Description of the Prior Art

Typical pads comprise two types of pads. One type of the pads are soft pads and are provided on top of a table surface for writing purposes and for stamping purposes. The other type of pads are hard pads and are provided for protecting the table surface from being cut. A further rule is required to be disposed on the pad for cutting purposes. However, the users have to press the ruler hard in order prevent the rule from being moved.

The present invention has arisen to mitigate and/or obviate the afore-described disadvantages of the conventional pads.

SUMMARY OF THE INVENTION

The primary objective of the present invention is to provide a pad device which includes a rule that may be secured to the pad and that may be disengaged from the pad easily.

In accordance with one aspect of the invention, there is provided a pad device comprising a pad body including at least one edge portion having a hole formed therein, a screw engaged in the hole, a board including an opening for engaging with the screw and including two legs having a gap formed between the legs, the legs each including a bottom portion having a recess formed therein, a fastening means secured to the screw for securing the board to the pad body, and a rule including a shaft engaged in the recesses of the legs so as to allow the rule to rotate relative to the board and so as to allow the rule to be disengaged from the pad body when the board is secured to the pad body.

The screw includes a middle portion having a flat portion formed therein for engaging with the hole of the pad body so as to prevent the screw from rotating relative to the pad body.

The board includes a passageway communicating with the opening for engaging with the screw so as to allow the screw to be disengaged from the board.

The rule includes at least one edge having a metal strip secured thereto for protecting the rule from being cut.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
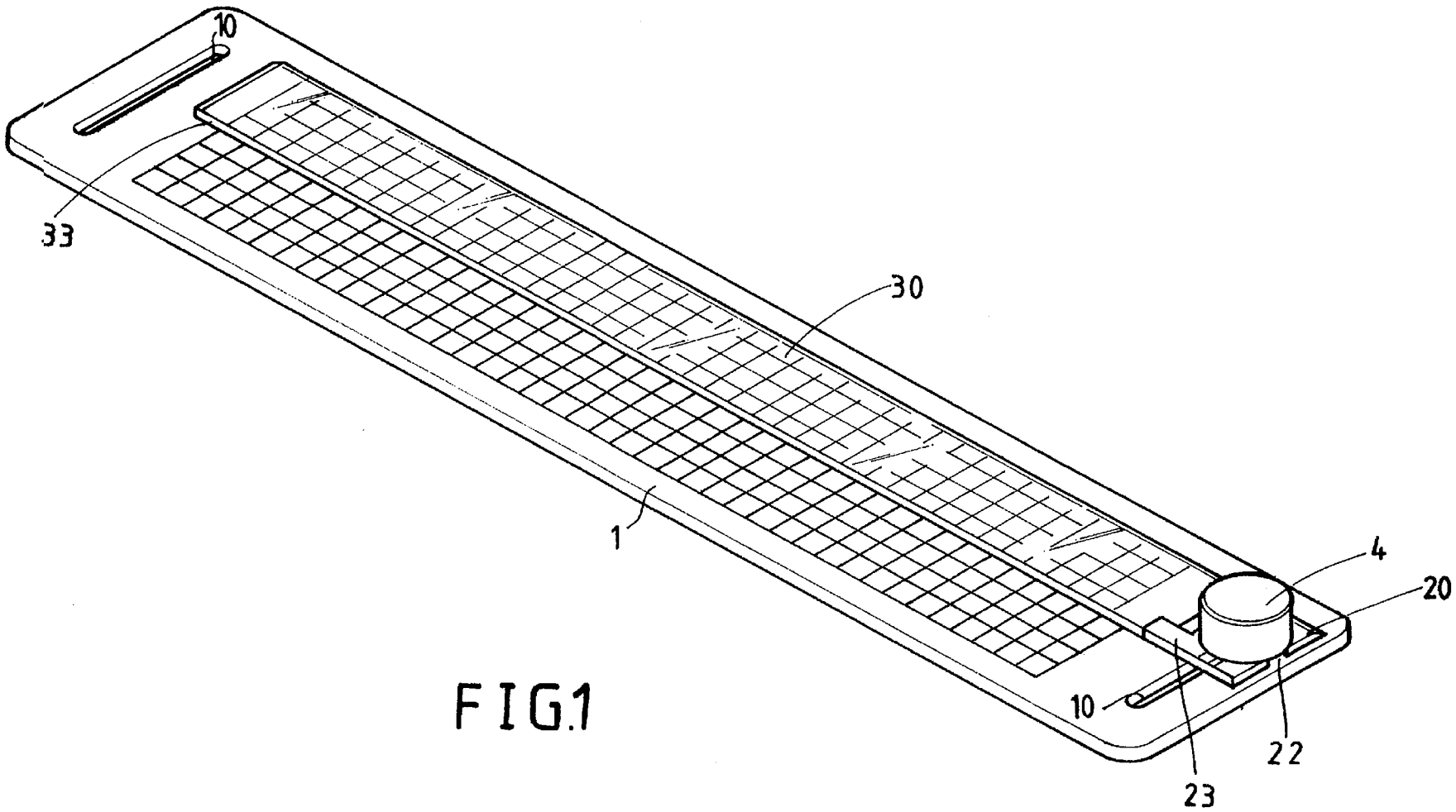
FIG. 1 is a perspective view of a pad device in accordance with the present invention.
Figures 2, 3:
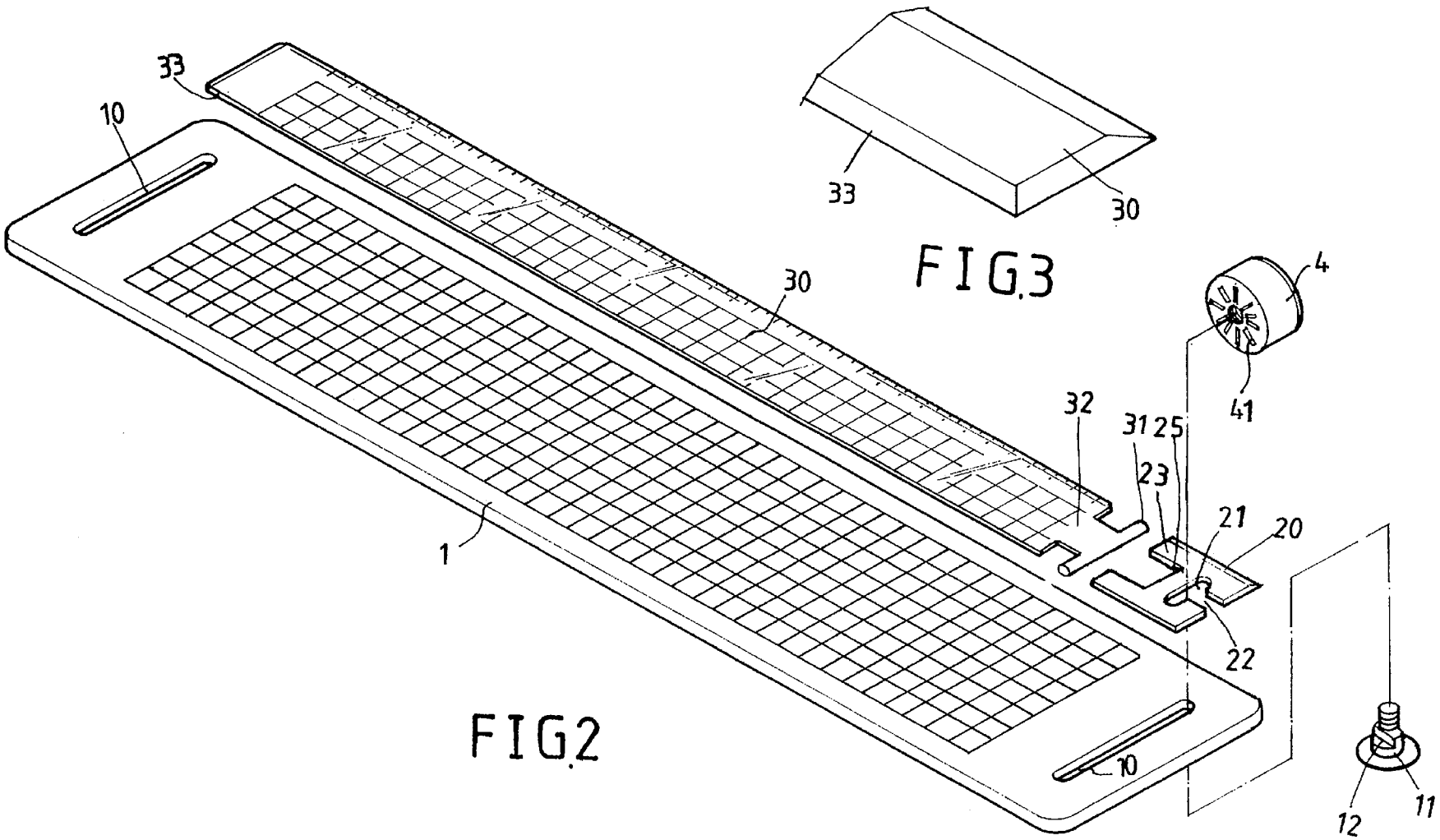
FIG. 2 is an exploded view of the pad device.
FIG. 3 is a partial perspective view of the rule.

Referring to FIGS. 1 and 2, a pad device in accordance with the present invention comprises a pad body 1 including two end portions each having an oblong hole 10 formed therein for engaging with a screw 11. The screw 11 includes a flat portion 12 formed in the lower portion for engaging with the oblong holes 10 such that the screw 11 can be prevented from rotating relative to the pad body 1. A knob 4 includes an inner thread 41 formed therein for engaging with the screw 11. The pad body 1 includes a hardness that is good enough for protecting the table surface from being cut.

Figure 4:
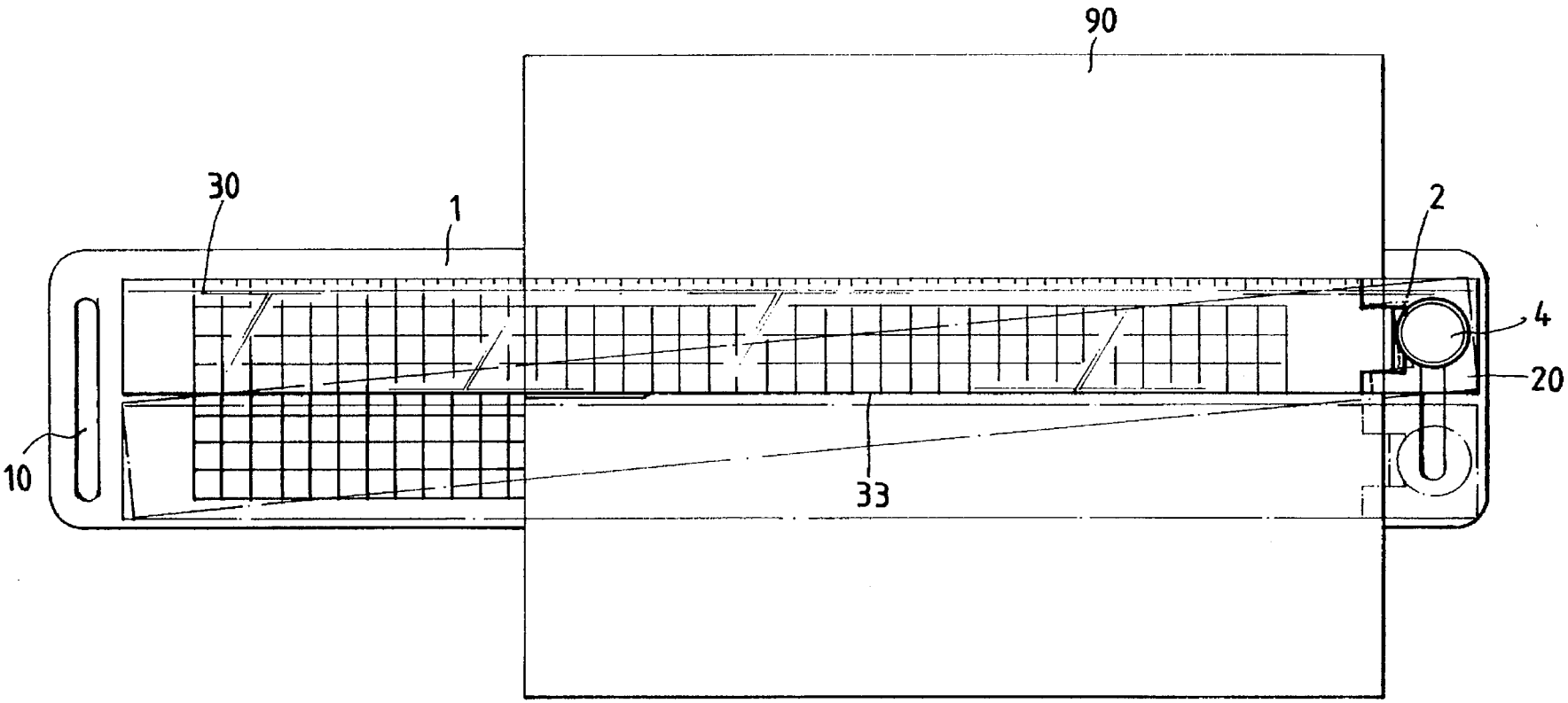
FIG. 4 is a top plane view illustrating the applications of the pad device.
Figure 5:
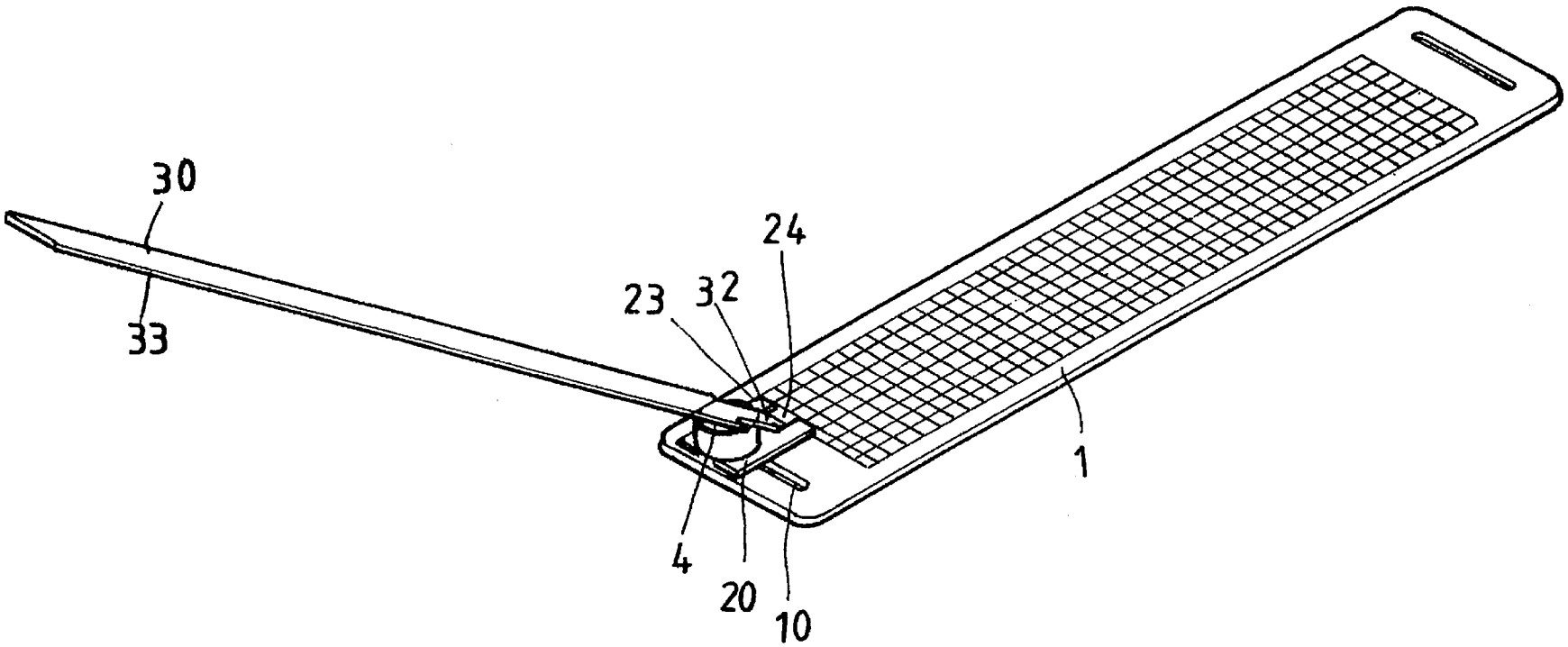
FIG. 5 is a perspective view illustrating the operation of the pad device.

A board 20 includes an opening 21 for engaging with the screw 11 which may secure the board 20 to the pad 1, and includes a passageway 22 communicating with the opening 21 such that the screw 11 may be easily engaged in the opening 21 via the passageway 22 when the knob 4 is not tightly threaded to the screw 11. It is preferable that the flat portion 12 of the screw 11 is not engaged in the opening 21 such that the board 20 may rotate relative to the screw 11 before the knob 4 is tightly threaded to the screw 11. The board 20 includes two legs 23 each having a recess 25 formed in the bottom portion thereof. A gap 24 is formed between the legs 23. A rule 30 includes a shaft 31 for engaging with the recesses 25 of the legs 23 and has a neck 32 for engaging with the gap 24 such that the rule 30 may rotate relative to the board 20 about the shaft 31, best shown in FIG. 5. The rule 30 includes one edge having a metal strip 33 for engaging with the knife so as to protect the rule 30 from being cut, best shown in FIG. 3. As shown in FIG. 4, a paper sheet 90 may be engaged between the pad body 1 and the rule 30 so as to be cut by a knife which may be easily and safely engaged along the metal strip 33 of the rule 30.

It is to be noted that the rule 30 can be disengaged from the pad body 1 (FIG. 5) such that the whole pad body 1 can be used as a flat surface. When the rule 30 is folded downward to engage with the pad body 1, a knife may engage with the rule 30 in order to cut a paper sheet. The screw 11 may be moved along the oblong hole 10 to any suitable position when the knob 4 is slightly unthreaded relative to the screw 11. In addition, the board 20 may be easily disengaged from the screw 11 when the screw 11 is moved through the passageway 22 of the board 20.

Accordingly, the pad device in accordance with the present invention includes a rule that may be secured to the pad and that may be disengaged from the pad easily.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A pad device comprising:

a pad body including at least one edge portion having a hole formed therein, a screw engaged in said hole, a board including an opening for engaging with said screw and including two legs having a gap formed between said legs, said legs each including a bottom portion having a recess formed therein, a fastening means secured to said screw for securing said board to said pad body, and a rule including a shaft engaged in said recesses of said legs so as to allow said rule to rotate relative to said board and so as to allow said rule to be disengaged from said pad body when said board is secured to said pad body.

2. A pad device according to claim 1, wherein said screw includes a middle portion having a flat portion formed therein for engaging with said hole of said pad body so as to prevent said screw from rotating relative to said pad body.

3. A pad device according to claim 1, wherein said board includes a passageway communicating with said opening for engaging with said screw so as to allow said screw to be disengaged from said board.

4. A pad device according to claim 1, wherein said rule includes at least one edge having a metal strip secured thereto for protecting said rule from being cut.

* * * * *